US005431326A

United States Patent [19]

Ni et al.

[11] Patent Number: 5,431,326

[45] Date of Patent: Jul. 11, 1995

[54] METHOD OF FORMING A TUBULAR MEMBER WITH SEPARATE FLANGE

[75] Inventors: Chi-Mou Ni, Troy; Charles J. Bruggemann, Rochester Hills, both of Mich.

[73] Assignee: General Motors Corporation, Detroit, Mich.

[21] Appl. No.: 302,001

[22] Filed: Sep. 7, 1994

[51] Int. Cl.[6] ..... B21D 26/02; B23K 31/02; B23K 101/08

[52] U.S. Cl. ..... 228/155; 29/421.1; 228/157

[58] Field of Search ..... 228/155, 157; 29/421.1

[56] References Cited

U.S. PATENT DOCUMENTS

| | | | |
|---|---|---|---|
| 4,377,732 | 3/1983 | Preller | 228/155 X |
| 5,050,299 | 9/1991 | Rainville | 228/157 X |
| 5,092,512 | 3/1992 | Sturrus et al. | 228/155 X |
| 5,333,775 | 8/1994 | Bruggemann et al. | 228/155 X |
| 5,339,667 | 8/1994 | Shah et al. | 29/421.1 X |

*Primary Examiner*—Kenneth J. Ramsey
*Attorney, Agent, or Firm*—Patrick M. Griffin

[57] ABSTRACT

A hydroformed vehicle body component has an attachment flange or the like-formed as an integral part of the hydroforming process. For a given flange shape, a parting plane for the dies is established relative to which the various surfaces of the flange shape, in cross section, have no significant reverse curvature. Then, a weld line is established which is on or substantially parallel to the parting plane, and which is as symmetrical to the flange as possible. A planar blank sufficient in size to produce the flange is pre welded to a cylindrical blank along the weld line, at the desired location. Shoulders bordering the die cavities and corresponding in shape to the desired flange shape simultaneously form the flange as the dies close. After the dies are closed, the tubular blank is pressurized and formed to shape as usual.

3 Claims, 3 Drawing Sheets

METHOD OF FORMING A TUBULAR MEMBER WITH SEPARATE FLANGE

BACKGROUND OF THE INVENTION

This invention relates to a method of forming a tubular member in general, and specifically to a method of simultaneously forming a tubular member with a flange.

Hydroformed tubular members used as structural components in a vehicle body frame or subframe often have to be structurally joined at some point along their length to other vehicle body members. Therefore, it is useful if the tubular member as formed can be given a localized attachment flange, of the proper shape and size, that is formed as part of the basic hydroforming process, without having to be welded on after the fact.

U.S. Pat. No. 5,070,717 to Boyd et al, co assigned, shows such a process. As disclosed, the dies that close around the cylindrical tubular blank before it is internally pressurized have a pair of spaced shoulders that pinch off and flatten a portion of the tube. This creates a closed, double thickness flange on the side of the fully formed tube that is a continuation of the closed interior of the tube. The flange so formed cannot be made particularly wide, nor with a complex, open shape. A flange so limited can be used in some applications, however, and the great advantage of the method is that it involves essentially no process steps beyond the basic forming process itself.

In applications where a wider and complex, open shaped flange is needed, it is simply stamped out separately and welded on as a final step. It would be an economic advantage to incorporate at least some of the processing of such a flange into the hydroforming process, as well.

SUMMARY OF THE INVENTION

The subject invention provides an apparatus and method in which much of the flanging operation is incorporated into the hydroforming process.

In the embodiment disclosed, a planar metal blank with a surface area sufficient to provide the total surface area of the desired flange shape is pre welded to the tubular blank, at the desired flange location, to create a compound blank. The upper and lower hydroforming dies have mating shoulders located to the side of their central cavities that correspond to the upper and lower surfaces respectively of the desired final flange shape. The compound blank is positioned between the dies, which are then closed around it. As the dies close, the mating die shoulders simultaneously stamp the desired flange shape from the planar portion of the compound blank. After the dies are fully closed, the flange shape is held independently as the interior of the tubular portion of the compound blank is pressurized and expanded to shape in the closed die cavities. After the fully formed tube is removed, the flange has the proper shape and location, with no further processing being necessary. If desired, however, additional, strengthening welding may be done. This will be simpler, since the flange has more surface area in abutment with the rest of the tube that the planar blank had.

DESCRIPTION OF THE PREFERRED EMBODIMENT

These and other feature of the invention will appear from the following written description, and from the drawings, in which.

Figure 6:
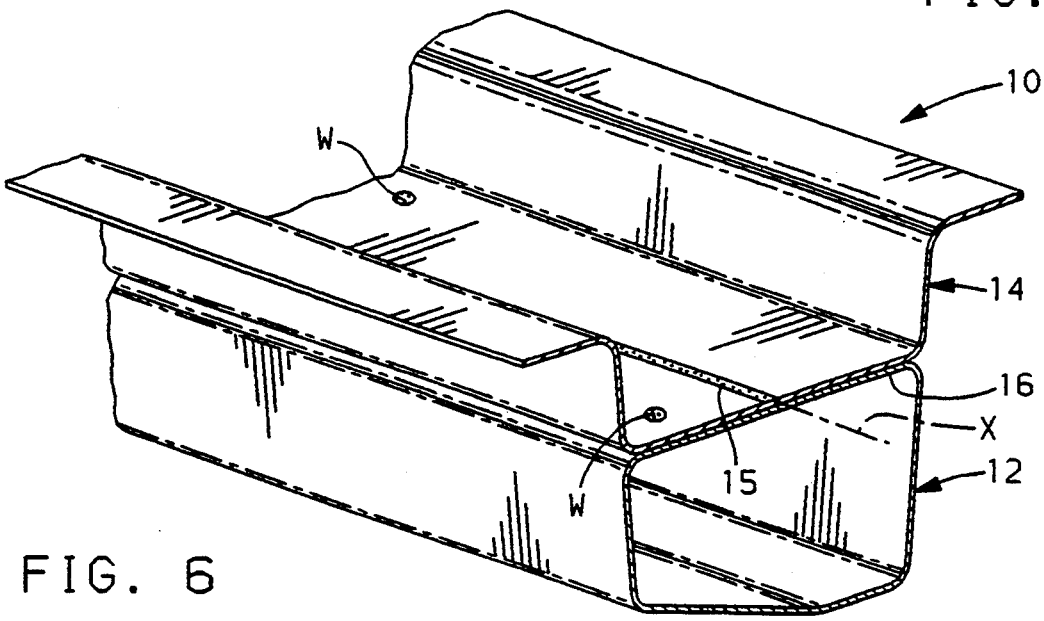
FIG. 6 is a perspective view of a portion of the fully formed tube.
Figure 7:
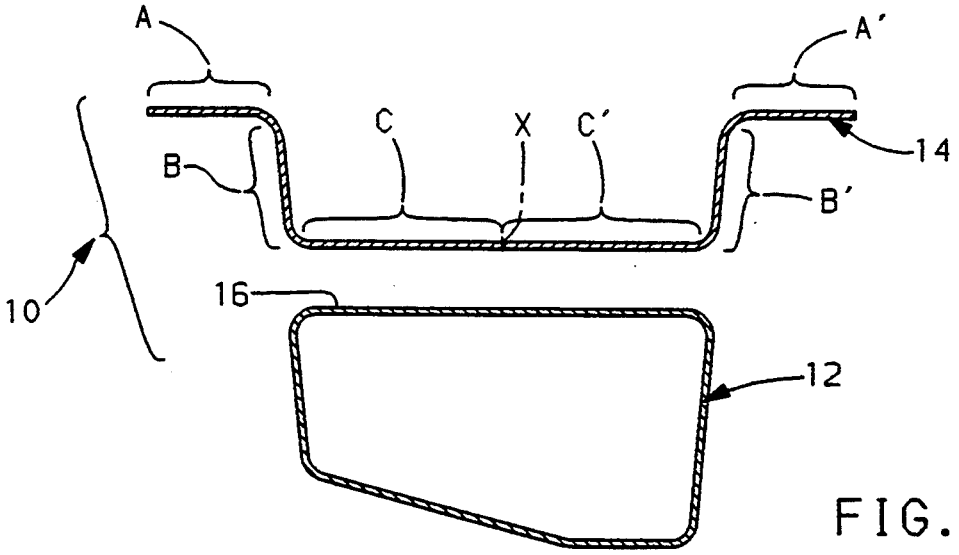
FIG. 7 is a cross section of the open and closed portions of the fully formed tube exploded to illustrate constitute sections thereof.

Referring first to FIGS. 6 and 7, the fully formed body structural component made by the apparatus and method of the invention, indicated generally at 10, includes a closed, central tubular portion, indicated generally at 12, and an open flange, indicated generally at 14. By closed, it is meant that tubular portion 12 has an enclosed inner surface (except for its open ends) that is, therefore, capable of being internally pressurized, and thereby formed to shape. By open, it is meant that flange 14 does not have an enclosed interior surface, as a tube does, and so must be formed to final shape from an initially flat blank by stamping or otherwise. Component 10 would most likely be all steel, but could be any other metal desired, such as aluminum. It would be unlikely that flange 14 would be a differing metal, however. Flange 14 is fixed to tubular portion 12 in a fashion described in more detail below. Initially, it need only be noted that flange 14 can be arbitrarily, but logically, divided into several constituent subsections defined relative to a central dividing line X. As illustrated, flange 14 has stepped flat portions A, B and A', B', integral with flat center sections C, C'. In the embodiment disclosed, flange 14 is essentially symmetrical about X, but need not be. Furthermore, the various flange sections A, B, etc, need not be totally flat. What is important for purposes of analysis and processing is that a line X be established that is parallel to as many flange surfaces as possible, (and, therefore, effectively parallel to a parting plane along which dies will open and close, as described below) and, if possible, one that effectively bifurcates the flange shape, for reasons described more fully below. It is also important that the cross sectional shape of flange 14 (a cross section taken perpendicular to a plane through, or at least parallel to, the welds made along dividing line X) not have any reverse curvature, as measured relative to that plane (shown by a dotted line in FIG. 6). To give specific examples, this would mean that the upper surface of section C would form a 90 degree or greater angle with the upper surface of section B, and the same for the angle formed between the lower surfaces of B and A. However, the various sections could be somewhat curved, so long as their curvature did not reverse relative to the plane. The reason for this will appear more clearly below. It will also be noted that the total width of the flange sections C and C', which are integral, is equal to the width of a flat top section 16 of the tubular portion 12. This structural relation is not absolutely necessary to the practice of the invention, but gives a structural advantage in the resulting product, as will appear more fully below.

Figure 2:
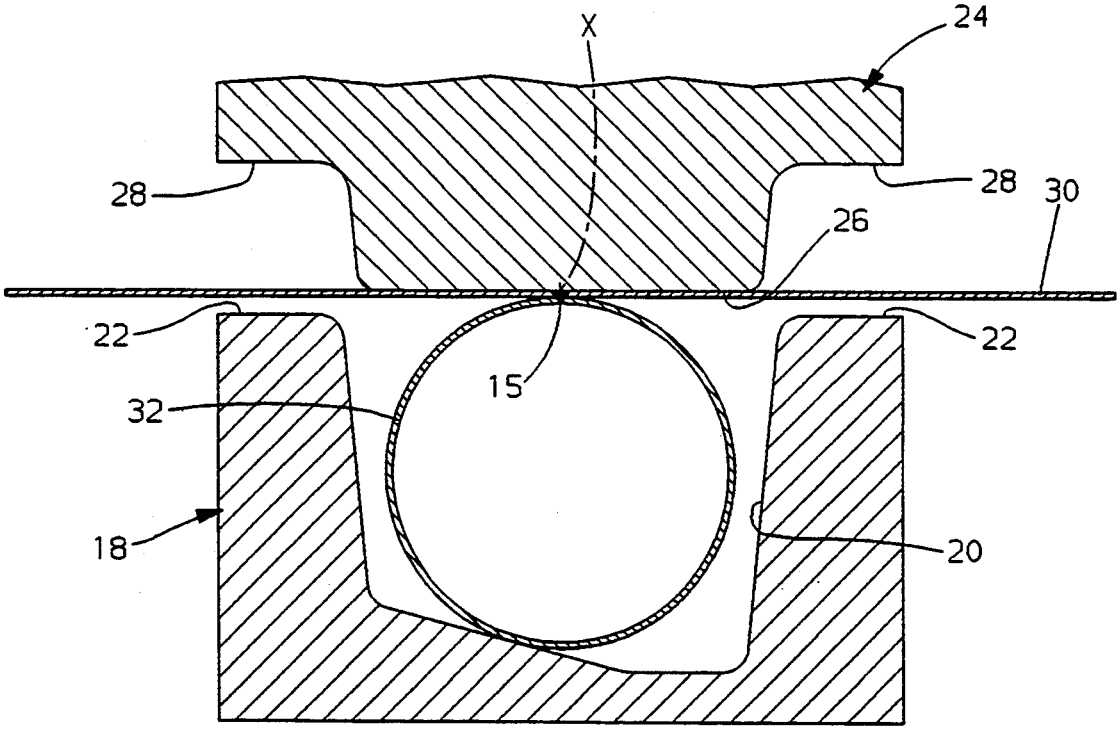
FIG. 2 is a cross section of a pair of dies beginning to close over the compound blank.

Referring next to FIG. 2, the apparatus for practicing the invention derives heavily from standard hydroforming technology, as will readily appear to those skilled in the hydroforming art. The basic apparatus that would be used could be like that disclosed in coassigned U.S. Pat. No. 5,233,856, which is herein incorporated by reference. The basic hydroforming process consists of upper and lower machined cavity dies closing over a cylindrical blank, with the ends of the blank plugged, and then highly pressurizing the interior of the blank to expand it out into the shape of a surrounding cavity. That same basic process occurs here, as well, with certain modifications in the apparatus, detailed in FIG. 2. A lower, female die indicated generally at 18, has a central cavity 20 that corresponds to the shape of the lower surface of the tubular portion 12, that is, to all of the outer surface except for the flat section 16. Located to either side of central cavity 20 are a pair of shoulders 22. The shoulders 22 correspond, in general, to the shape of the lower surface of flange 14, and specifically to the undersurface of the sections A, B and A', B' described above. By "correspond," it is meant that the shoulders 22 match the flange sections noted in terms of width, length, total area, and final shape. An upper, male die, indicated generally at 24, has a central "cavity" 26 corresponding in shape to the upper surface of the tubular portion 12 (i.e., to flat section 16), a term that is used very broadly since die 24 is a male die. Fundamentally, cavity 20 and "cavity" 26 mate to form a complete surrounding cavity, as will appear below. As with lower die 18, a pair of shoulders 28 correspond in shape to the upper surface of the same flange sections A, B and A', B'. The dies 18 and 24 cooperate to create the fully formed component 10, as described next.

Figure 1:
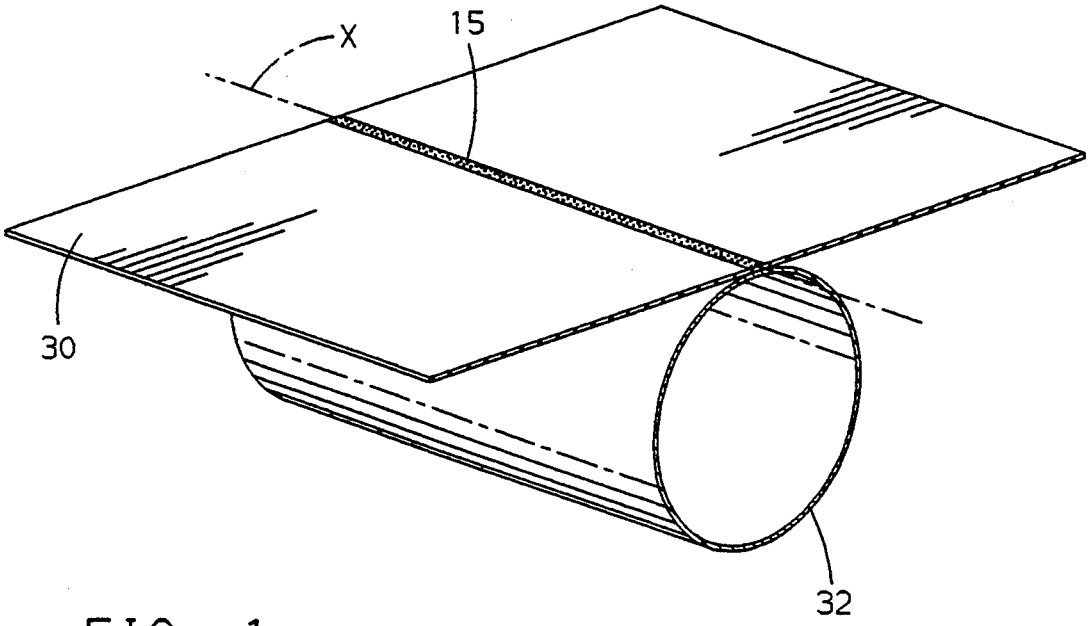
FIG. 1 is a perspective view of a portion of a compound blank made according to the invention, with the planar blank pre welded to the tubular blank.

Referring next to FIG. 1, a compound blank is first produced by welding a planar blank 30 to a cylindrical tubular blank 32. The weld line 15, shown by a series of small x's, corresponds to the line X described above, and is tangent to the outer surface of tubular blank 32 and parallel to its axis. Welding would be done by one sided spot welding, laser welding, or any other joining process that works with one side only access. While planar blank 30 is long and wide enough to make up the total length and width of flange 14, it is unlikely that it would be nearly as long as cylindrical blank 32, since flange 14 is typically just a localized, discrete structure. It could be as long as desired, however. Because flange 14 is symmetrical about the line X, planar blank 30 is centered on cylindrical blank 32, though it need not be, if flange 14 were not symmetrical. A number of compound blanks would typically be prepared before the forming process, described next, was run.

Figure 3:
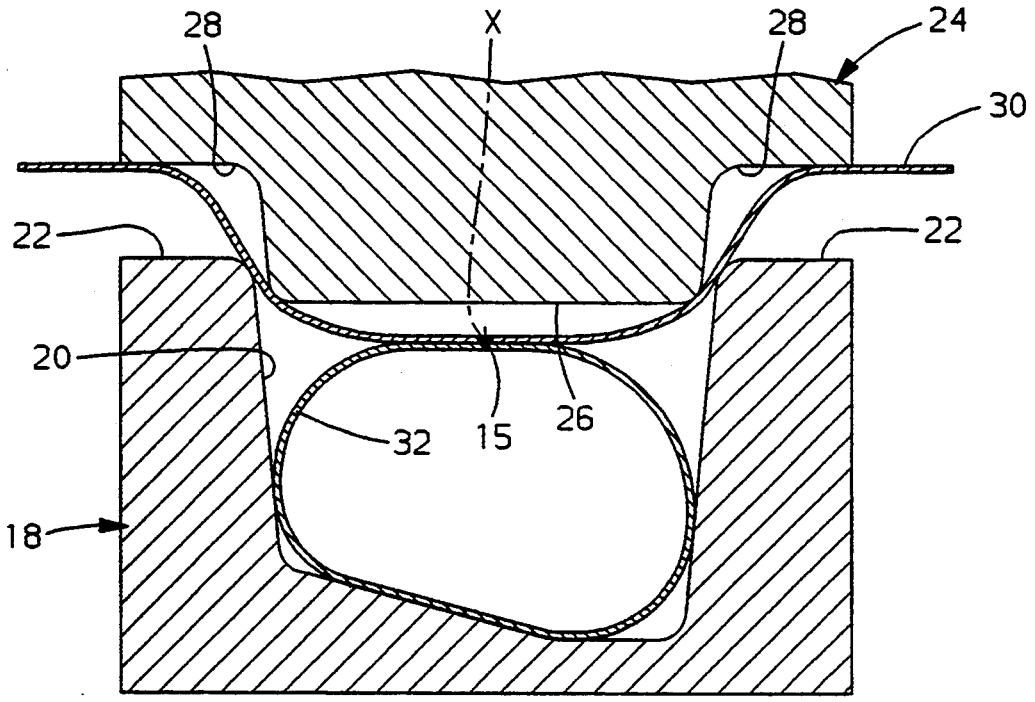
FIG. 3 is a view like FIG. 2, showing the dies partially closed and the flange partially stamped to shape.

Referring next to FIGS. 2 and 3, the compound blank just described is placed between the dies 18 and 24, with the planar blank 30 registered with the matching shoulders 22 and 28. At the same time, the other features of the standard hydroforming apparatus of which the dies 18 and 24 are a part, such as the plugs, would be activated. The dies 18 and 24 are closed upon one another, as seen in FIG. 3, which begins to crush the cylindrical blank 32 into the shape of the cavity 20. Depending on the complexity of the cross sectional shape into which the tubular blank 32 is ultimately to be formed, it might be necessary to pre pressurize it to a certain level, so as to prevent wrinkling, but that is standard hydroforming process. The die closure also simultaneously begins to bend the planar blank 30 between the corners of the shoulders 22 and 28, which are rounded so as to ease the process by which the planar blank 30 is drawn down and in. If needed, a standard drawing compound would be used for surface lubrication. The central, symmetrical, even location of the weld line 15 assures that it is stressed evenly during the stamping process, pulled to the left as much as to the right, and not twisted along its length. Since the dies 18 and 24 are closed together as part of any hydroforming process, the operator need do nothing different than would be done in any hydroforming operation.

Figure 4:
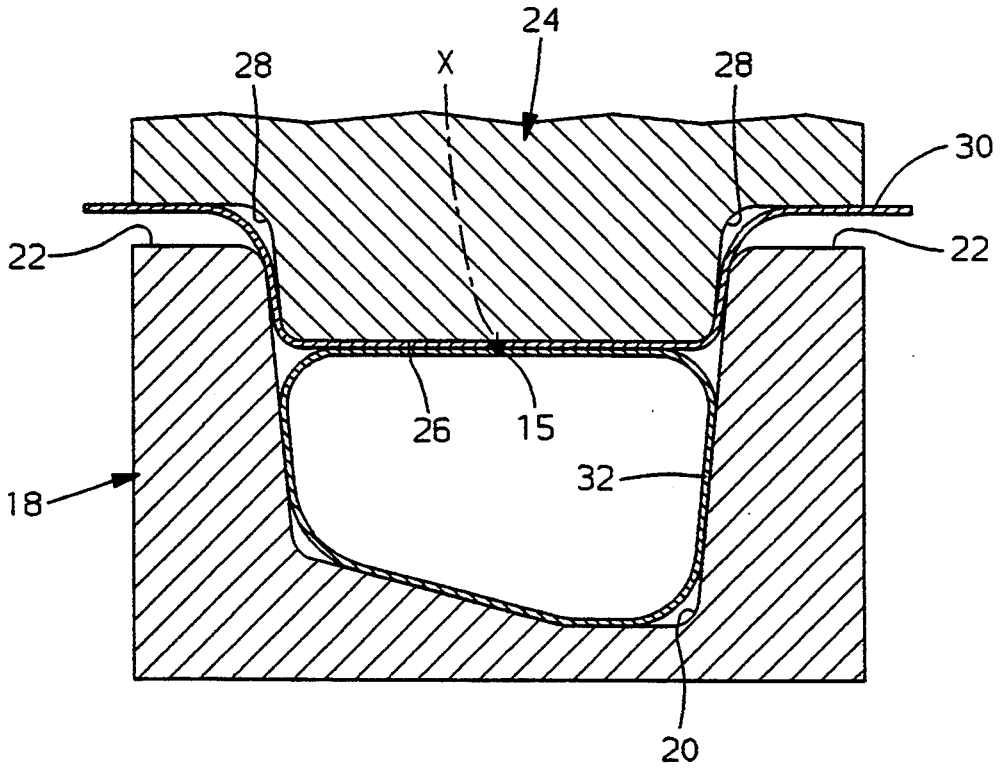
FIG. 4 is a view like FIG. 3, showing the dies almost completely closed and the flange almost totally formed.
Figure 5:
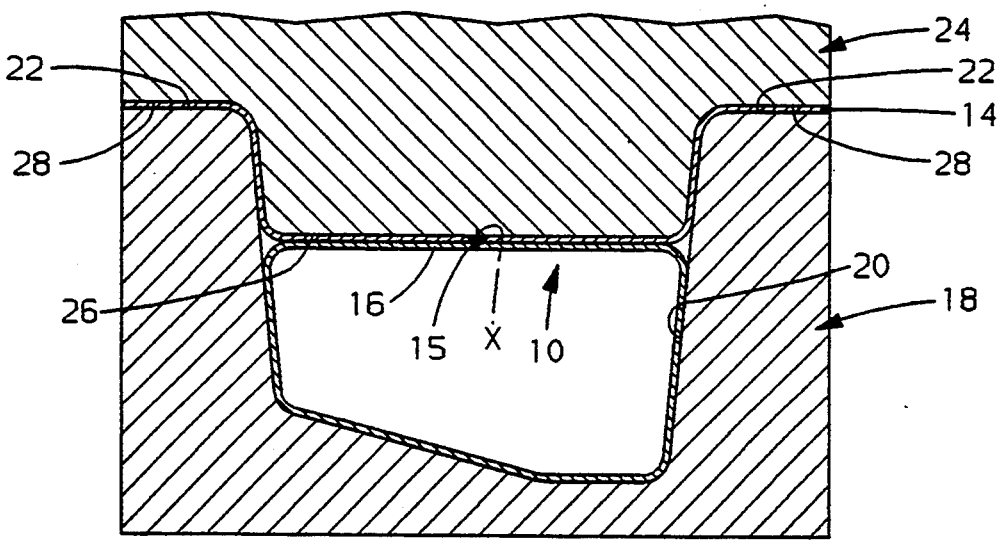
FIG. 5 is a view like FIG. 4, showing the dies completely closed and the tube fully formed.

Referring next to FIGS. 4 and 5, further closure of the dies 18 and 24 continues the deformation process, taking planar blank 30 almost to the final shape of flange 14, as seen in FIG. 4. At the FIG. 4 point, flange 14 has been almost fully formed, and the edges of planar blank 30 have been dragged almost fully down and into the dies 18 and 24. After the dies 18 and 24 have closed fully, flange 14 is fully formed between the shoulders 22 and 28, or at least the outlying portions A, A' and B, B' thereof. At that point, the interior of tubular blank 32 is pressurized fully to expand it out completely into the almost exact shape of the cavity formed by the two cavity parts 26 and 20. Again, this would be done as in standard hydroforming procedure, and the fact that a flange 14 had already been formed would be transparent to the operator. As the tubular portion 12 takes on its final shape, flattening out top section 16, the center portions C, C' of flange 14 are flattened out as well, and the two are sandwiched into close abutment.

Referring again to FIGS. 6 and 7, the end result is the fully formed component 10, which is removed from between the dies 18 and 24 after they are parted and de pressurized. The tube ends, within which the plugs reside, would have to be trimmed, but, again, that is standard procedure, and is not separately illustrated. The importance of flange 14 having the type of shape that it has, with no reverse bends, can be understood in light of the stamping process just described. This allows it to be formed, without binding or catching, by male and female dies that close and part along a plane. After removal, the weld line 15, given its deliberately force neutral location, has likely survived the stamping process fairly intact. However, some post welding steps might be desired to add extra strength. Once the flange 14 and central flat surface have been sandwiched together, there is then plenty of intimately contacting surface area amenable to further welding, as at the locations marked W in FIG. 6. In such case, the flange 14 acts as a strengthener and stiffener, effectively creating an I beam section, beyond simply providing a hanger or attachment structure.

A number of variations of the flange 14 shown could be produced by the method and apparatus disclosed. A flange with only one side, for example, with just the sections A and B, or just A' and B', could be formed in the same fashion. Obviously, the planar blank 30 would be less wide, in that case. Or, two separate flanges, each with a shape like A, B and A', B' could be formed, without the integral portion C, C'. In that case, two different planar blanks and two different initial weld lines would be used. The general methodology would be the same. The planar blank 30 need not be completely flat initially, but could be given a shallow pre curve, similar to the shape in FIG. 3, and so eliminate some of the strain in the stamping operation. In general, with any flange of any desired shape, the designer would first determine an orientation for the flange shape to assure that there was no, or at least very minimal, reverse curvature relative a potential direction of die closing and parting motion. To a certain extent, the process might drive the flange shape, rather than vice versa, in that flanges would be deliberately designed to be suitable for the forming process described. Then, a weld line would be established that would leave sufficient overlap between the flange and the rest of the tube so as to provide a good structural bond, just as the flange sections C—C′ and tube flat section 16 provide. The weld line should also be situated, as detailed above, so as to be substantially symmetrical relative to the constituent sections of the flange shape, and substantially parallel to those sections, and therefore substantially parallel to the plane along which the dies will open and close. The weld line will thereby be at a substantially force neutral location during the stamping and drawing process and be subjected to only minimal stress and strain during the stamping and drawing process. Following these design considerations should allow open flanges of most shapes to be successfully simultaneously formed along with the closed portions of tubular vehicle body structural members. Therefore, it will be understood that it is not intended to limit the invention to just the embodiment disclosed.

The embodiments of the invention in which an exclusive property or privilege is claimed are defined as follows:

1. A method of forming an elongated vehicle body structural component having a closed portion and an open flange, comprising the steps of, providing a first die having a center cavity corresponding in shape to the lower surface of said tubular portion and a shoulder section corresponding in shape to the lower surface of said flange, providing a second die having a center cavity corresponding in shape to the upper surface of said tubular portion and a shoulder section corresponding in shape the upper surface of said flange, providing a tubular blank having a closed cross section with a circumferential measure substantially equal to said tubular portion, providing a substantially planar blank having a surface area substantially equal to said open flange, securing said planar blank to said tubular blank so as to provide a compound blank, positioning said compound blank between said dies, progressively closing said dies around said compound blank so as to simultaneously stamp said planar blank between said die shoulders to produce said flange while deforming said tubular blank between said die cavities to partially form said tubular portion, and, pressurizing said tubular blank so as to completely form said tubular portion between said cavities.

2. A method of forming an elongated vehicle body structural component having a closed portion and an open flange, comprising the steps of, dividing said flange shape into constituent, substantially planar sections, establishing a parting plane relative to which a cross section of said flange taken perpendicular to said parting plane has minimal reverse curvature relative to said parting plane, establishing a weld line that is substantially parallel to parting plane, providing a first die movable along said parting plane and having a center cavity corresponding in shape to the lower surface of said tubular portion and a shoulder section corresponding in shape to the lower surface of said flange, providing a second die movable along said parting plane and having a center cavity corresponding in shape to the upper surface of said tubular portion and a shoulder section corresponding in shape the upper surface of said flange, providing a tubular blank having a closed cross section with a circumferential measure substantially equal to said tubular portion, providing a substantially planar blank having a surface area substantially equal to said open flange, securing said planar blank to said tubular blank so as to provide a compound blank, positioning said compound blank between said dies, progressively closing said dies around said compound blank so as to simultaneously stamp said planar blank between said die shoulders to produce said flange while deforming said tubular blank between said die cavities to partially form said tubular portion, and, pressurizing said tubular blank so as to completely form said tubular portion between said cavities.

3. A method of forming an elongated vehicle body structural component having a closed portion and an open flange, comprising the steps of, dividing said flange shape into constituent, substantially planar sections, establishing a parting plane relative to which a cross section of said flange taken perpendicular to said parting plane has minimal reverse curvature relative to said parting plane, establishing a weld line that is substantially parallel to parting plane and which substantially bifurcates said flange, providing a first die movable along said parting plane and having a center cavity corresponding in shape to the lower surface of said tubular portion and a shoulder section corresponding in shape to the lower surface of said flange, providing a second die movable along said parting plane and having a center cavity corresponding in shape to the upper surface of said tubular portion and a shoulder section corresponding in shape the upper surface of said flange, providing a tubular blank having a closed cross section with a circumferential measure substantially equal to said tubular portion, providing a substantially planar blank having a surface area substantially equal to said open flange, securing said planar blank to said tubular blank so as to provide a compound blank, positioning said compound blank between said dies, progressively closing said dies around said compound blank so as to simultaneously stamp said planar blank between said die shoulders to produce said flange while deforming said tubular blank between said die cavities to partially form said tubular portion, and, pressurizing said tubular blank so as to completely form said tubular portion between said cavities.

* * * * *